US006176486B1

(12) United States Patent
Maciasz

(10) Patent No.: US 6,176,486 B1
(45) Date of Patent: Jan. 23, 2001

(54) BOARD GAME

(76) Inventor: Larry Maciasz, 4011 Cemetery Rd., Fowlerville, MI (US) 48836

( * ) Notice: Under 35 U.S.C. 154(b), the term of this patent shall be extended for 0 days.

(21) Appl. No.: 09/238,926

(22) Filed: Jan. 28, 1999

(51) Int. Cl.[7] ..... A63F 3/00
(52) U.S. Cl. ..... 273/243; 273/258; 273/260
(58) Field of Search ..... 273/236, 241, 273/242, 243, 258, 260

(56) References Cited

U.S. PATENT DOCUMENTS 1,138,233 * 5/1915 Maris .
1,182,802 * 5/1916 Schneider .
1,204,246 * 11/1916 Carter .
3,065,969 * 11/1962 Jennens .
4,194,741 * 3/1980 Rea .
4,339,136 * 7/1982 Gittings .
4,515,370 * 5/1985 Garcia .
5,791,650 * 8/1998 Pardee .

* cited by examiner

*Primary Examiner*—Sebastiano Passaniti
*Assistant Examiner*—Vishu Mendiratta

(57) ABSTRACT

A board game for entertaining players of the game. The board game includes a playing surface with a center region and a generally rectangular outer perimeter. The playing surface has a plurality of starting space sets, each positioned towards a corner of the playing surface and comprising a plurality of starting spaces. The playing surface also has a plurality of playing spaces. The playing spaces are divided into four generally rectangular quadrants positioned towards the corners of the playing surface. A plurality of sets of playing pieces are positionable on the playing surface. A plurality of dice are provided.

1 Claim, 2 Drawing Sheets

BOARD GAME

BACKGROUND OF THE INVENTION

1. Field of the Invention

The present invention relates to board games and more particularly pertains to a new board game for entertaining players of the game.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,261,574; U.S. Pat. No. 5,692,753; U.S. Pat. No. 4,103,898; U.S. Pat. No. 3,894,738; U.S. Pat. No. 2,006,176; and U.S. Pat. No. Des. 34,044.

While these devices fulfill their respective, particular objectives and requirements, the aforementioned patents do not disclose a new board game. The inventive device includes a playing surface with a center region and a generally rectangular outer perimeter. The playing surface has a plurality of starting space sets, each positioned towards a corner of the playing surface and comprising a plurality of starting spaces. The playing surface also has a plurality of playing spaces. The playing spaces are divided into four generally rectangular quadrants positioned towards the corners of the playing surface. A plurality of sets of playing pieces are positionable on the playing surface. A plurality of dice are provided.

In these respects, the board game according to the present invention substantially departs from the conventional concepts and designs of the prior art, and in so doing provides an apparatus primarily developed for the purpose of entertaining players of the game.

SUMMARY OF THE INVENTION

In view of the foregoing disadvantages inherent in the known types of board games now present in the prior art, the present invention provides a new board game construction wherein the same can be utilized for entertaining players of the game.

The general purpose of the present invention, which will be described subsequently in greater detail, is to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

To attain this, the present invention generally comprises a playing surface with a center region and a generally rectangular outer perimeter. The playing surface has a plurality of starting space sets, each positioned towards a corner of the playing surface and comprising a plurality of starting spaces. The playing surface also has a plurality of playing spaces. The playing spaces are divided into four generally rectangular quadrants positioned towards the corners of the playing surface. A plurality of sets of playing pieces are positionable on the playing surface. A plurality of dice are provided.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

It is another object of the present invention to provide a new board game which may be easily and efficiently manufactured and marketed.

It is a further object of the present invention to provide a new board game which is of a durable and reliable construction.

An even further object of the present invention is to provide a new board game which is susceptible of a low cost of manufacture with regard to both materials and labor, and which accordingly is then susceptible of low prices of sale to the consuming public, thereby making such board game economically available to the buying public.

Still yet another object of the present invention is to provide a new board game which provides in the apparatuses and methods of the prior art some of the advantages thereof, while simultaneously overcoming some of the disadvantages normally associated therewith.

Still another object of the present invention is to provide a new board game for entertaining players of the game.

Yet another object of the present invention is to provide a new board game which includes a playing surface with a center region and a generally rectangular outer perimeter. The playing surface has a plurality of starting space sets, each positioned towards a corner of the playing surface and comprising a plurality of starting spaces. The playing surface also has a plurality of playing spaces. The playing spaces are divided into four generally rectangular quadrants positioned towards the corners of the playing surface. A plurality of sets of playing pieces are positionable on the playing surface. A plurality of dice are provided.

Still yet another object of the present invention is to provide a new board game that uniquely uses nuts, bolts, washers, and lock washers as playing pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
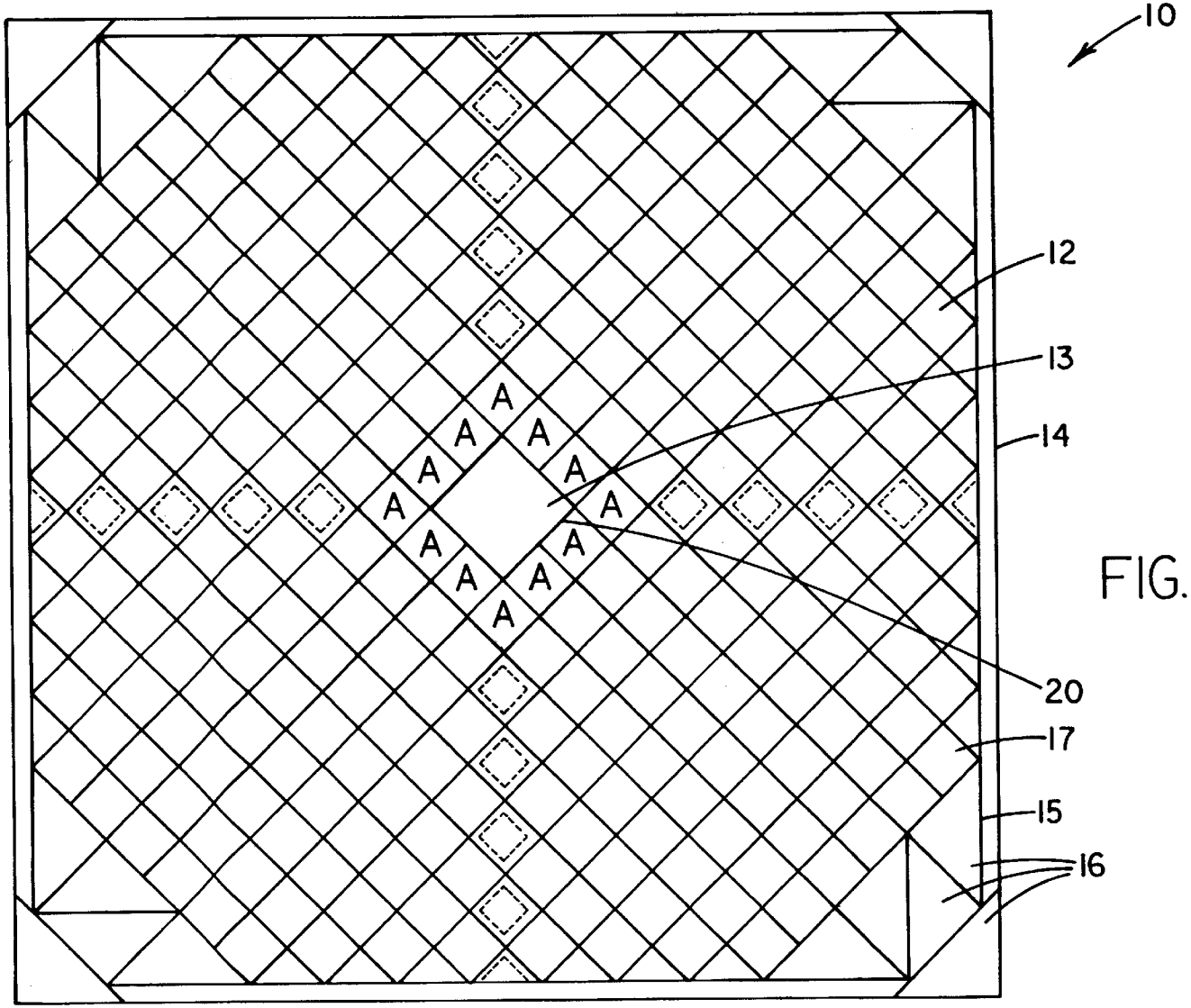
FIG. 1 is a schematic side view of a playing board of a new board game according to the present invention.
Figure 2:
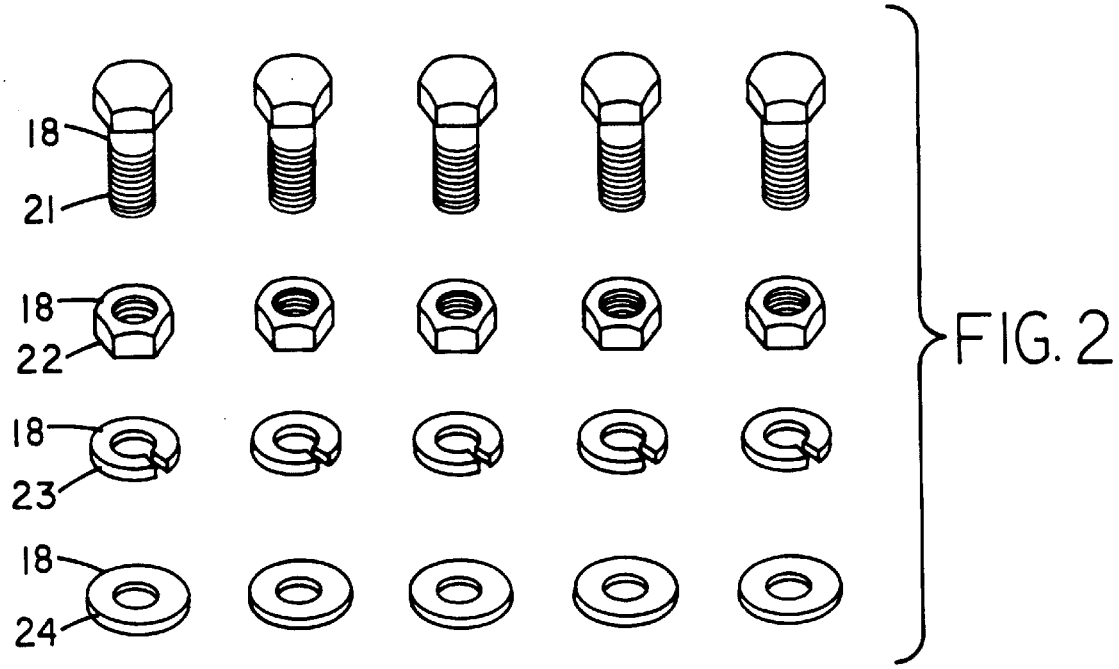
FIG. 2 is a schematic perspective view of playing pieces of the present invention.
Figure 3:
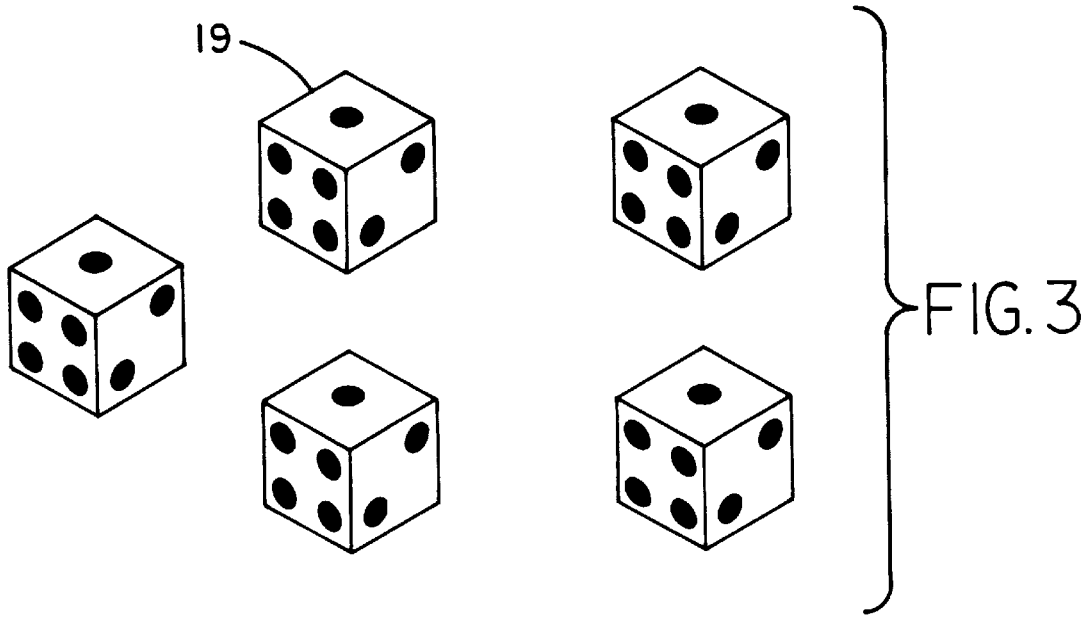
FIG. 3 is a schematic perspective view of dice of the present invention.

With reference now to the drawings, and in particular to FIGS. 1 through 3 thereof, a new board game embodying the principles and concepts of the present invention and generally designated by the reference numeral 10 will be described.

As best illustrated in FIGS. 1 through 3, the board game 10 generally comprises a playing surface 12 with a center region 13 and a generally rectangular outer perimeter 14. The playing surface has a plurality of starting space sets 15, each positioned towards a corner of the playing surface and comprising a plurality of starting spaces 16. The playing surface also has a plurality of playing spaces 17. The playing spaces are divided into four generally rectangular quadrants positioned towards the corners of the playing surface. A plurality of sets of playing pieces 18 are positionable on the playing surface. A plurality of dice 19 are provided.

Preferably, each of the starting spaces is generally triangular shaped. Ideally, each of the starting space sets has five starting spaces. Most ideally, as shown in FIG. 1, the starting spaces of each starting space set are positioned together such that the starting space set is generally triangular shaped. This permits three playing pieces to exit directly out of the starting space set while two playing pieces have to spend a movement point exiting the starting space set.

Also preferably, the rectangular playing are positioned adjacent each other and are arranged in rows. Ideally, the rows of the playing spaces are aligned with a line that diagonally extends between a pair of diagonally opposite corners of the playing surface.

Preferably, the playing surface has a center square 20 designed to disrupt straight movement across the board and a plurality of middle spaces (denoted by the letter "A" on FIG. 1) arranged in an annular path around the center square. Ideally, the center square is about the size of four playing spaces.

The playing spaces are divided into four generally rectangular quadrants positioned towards the corners of the playing surface and delineated on FIG. 1 as between the horizontal and vertical rows of squares has the dashed boxes therein. The quadrants do not include the middle spaces (A).

Preferably, the playing spaces in a first pair of diagonally opposed quadrants have a common color scheme. The playing spaces in a second pair of diagonally opposed quadrants have another common color scheme different from the first pair of quadrants so that a player moving diagonally across the board has a visual reference of where the player may position his or her playing pieces, since, as will be discussed below, a player is not allowed to stray into a quadrant that is not diagonally opposed to the player's starting quadrant.

Also preferably, the playing spaces positioned between the quadrants have a unique color scheme different than that of the two color schemes of the diagonal pairs of quadrants.

Preferably, as shown in FIG. 2, each set of playing pieces comprises five playing pieces. Ideally, a first set of playing pieces comprises five bolts 21. A second set of playing pieces comprises five nuts 22. A third set of playing pieces comprises five lock washers 23. A fourth set of playing pieces comprises five washers 25. Also ideally, five die are provided.

To begin a game, each player is provided with a set of playing pieces. A starting space set is assigned to each player. Ideally, if only two players are playing, the players are assigned starting space sets opposite each other so that their pieces are more likely to cross or get landed on by the pieces of another player.

The playing pieces are placed on the starting spaces. Only one playing piece is allowed per start space.

Each player rolls the die to determine which player starts first. The player with the highest roll starts first. All ties in value are rolled again.

Each of the players consecutively takes a plurality of turns in a clockwise direction beginning with the player starting first.

To take a turn, each player rolls the die to generate a plurality of movement values. Each dice provides one movement value so that several movement values are obtained from each roll of the die. The player assigns the movement values to the playing pieces. More than one movement value may be assigned to a particular playing piece.

The playing pieces are moved over a number of playing spaces equal to the movement value assigned to each playing piece by the player toward the start spaces of the diagonally opposite quadrant. For example, if a player rolls a 1, 2, 3, 4, and 5, the player can move a first playing piece one space, a second playing piece two spaces, and so on for each playing piece. Or a player can combine any number of movement values to move a particular playing piece, such as combining movement values worth 1, 3, and 4 to move a playing piece eight spaces.

Preferably, the playing pieces starting in a particular pair of diagonally opposed quadrants are restricted to movement within the pair of quadrants, but are permitted to move along the path formed by the middle spaces to move from one quadrant to another.

Also preferably, a player's playing piece is returned to its original position on a start space in his or her original start space set when an opponent's playing piece lands on the same playing space on which the player's playing piece rests.

A player's playing piece may also be returned to its original position on a start space in his or her original start space set when an opponent's playing piece lands on the same middle space on which the player's playing piece rests.

The first of the players to position all of his or her playing pieces on the starting spaces of the diagonally opposed quadrant is the winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for playing a board game, comprising the steps of:

providing a board game comprising:

a playing surface having a center region and a generally rectangular outer perimeter;

said playing surface having a plurality of starting space sets, each of said starting space sets being positioned towards a corner of said playing surface and comprising a plurality of starting spaces;

each of said starting spaces being generally triangular shaped;

wherein each of said starting space sets has five starting spaces;

said starting spaces of each starting space set being positioned together such that said starting space set is generally triangular shaped;

said playing surface having a plurality of adjacent generally rectangular playing spaces being arranged in rows;

said rows of said playing spaces being aligned with a line diagonally extending between a pair of diagonally opposite corners of said playing surface;

said playing surface having a center square for disrupting straight movement across said playing surface and a plurality of middle spaces arranged in an annular path around said center square, said center square having a size of about four of said playing spaces;

said playing spaces being divided into four generally rectangular quadrants positioned towards said corners of said playing surface;

wherein said playing spaces in a first pair of diagonally opposed quadrants have a common color scheme, said playing spaces in a second pair of diagonally opposed quadrants have another common color scheme different from said first pair of quadrants;

wherein said playing spaces positioned between said quadrants have a unique color scheme;

a plurality of sets of playing pieces being positionable on said playing surface;

wherein each set of playing pieces comprises five playing pieces;

wherein a first set of playing pieces comprises five nuts;

wherein a second set of playing pieces comprises five bolts;

wherein a third set of playing pieces comprises five lock washers;

wherein a fourth set of playing pieces comprises five washers;

a plurality of dice; and wherein five die are provided;

providing each player with a set of playing pieces;

assigning a starting space set to each player;

placing said playing pieces on said starting spaces;

determining a player to start first, wherein each player rolls said die to determine which player starts first, said player with the highest roll starting first, all ties in value being rolled again;

each of the players consecutively taking a plurality of turns in a clockwise direction, said turns comprising the steps of:

rolling said die to generate a plurality of movement values, each dice providing one movement value;

assigning said movement values to said playing pieces, wherein more than one movement value may be assigned to a particular playing piece;

moving said playing pieces over a number of playing spaces equal to the movement value assigned to each playing piece by the player toward said start spaces of the diagonally opposite quadrant;

said playing pieces starting in a particular pair of diagonally opposed quadrants being restricted to movement within said pair of quadrants; and moving said playing pieces along said path formed by said middle spaces to move from one quadrant to another;

returning a player's playing piece to its original position on said start space when an opponent's playing piece lands on the same playing space on which said player's playing piece rests;

returning a player's playing piece to its original position on said start space when an opponent's playing piece lands on the same middle space on which said player's playing piece rests; and a first of said players to position all of said player's playing pieces on said starting spaces of said diagonally opposed quadrant being the winner.

* * * * *